US008474996B2

(12) United States Patent
Zhang et al.

(10) Patent No.: US 8,474,996 B2
(45) Date of Patent: Jul. 2, 2013

(54) LED ILLUMINATION APPARATUS

(75) Inventors: Yu Zhang, Shenzhen (CN); Guang Yu, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 98 days.

(21) Appl. No.: 13/184,573

(22) Filed: Jul. 18, 2011

(65) Prior Publication Data

US 2012/0162975 A1 Jun. 28, 2012

(30) Foreign Application Priority Data

Dec. 27, 2010 (CN) ..... 2010 1 0607338

(51) Int. Cl.
*F21V 29/00* (2006.01)

(52) U.S. Cl.
USPC ..... 362/218; 362/294; 362/373; 362/249.02; 362/311.02

(58) Field of Classification Search
USPC ..... 362/218, 221, 373, 294, 311.02, 362/249.02
See application file for complete search history.

(56) References Cited

U.S. PATENT DOCUMENTS

| | | | | |
|---|---|---|---|---|
| 6,874,924 | B1 * | 4/2005 | Hulse et al. | 362/551 |
| 7,633,229 | B1 * | 12/2009 | Malkoff | 315/32 |
| 7,665,864 | B2 * | 2/2010 | Zheng et al. | 362/249.11 |
| 7,815,338 | B2 * | 10/2010 | Siemiet et al. | 362/218 |
| 2010/0172133 | A1 * | 7/2010 | Liu | 362/235 |

* cited by examiner

*Primary Examiner* — Ali Alavi
(74) *Attorney, Agent, or Firm* — Altis Law Group, Inc.

(57) ABSTRACT

An LED illumination apparatus includes a body, a light source module, a shell, and a driver. The light source module includes a substrate and an LED chip. The light source module is arranged on the body. The shell is made of transparent material and covers the light source module. The driver drives the light source module. A plurality of fins extends on one side of the body away from the light source module. The fins are integrally formed on the body by extrusion technology.

11 Claims, 3 Drawing Sheets

LED ILLUMINATION APPARATUS

BACKGROUND

1. Technical Field

The disclosure relates to illumination apparatuses, and particularly to an LED illumination apparatus.

2. Description of the Related Art

The many advantages of light emitting diodes (LEDs), such as high luminosity, low operational voltage, low power consumption, compatibility with integrated circuits, ease of driving, long term reliability, and environmental friendliness have promoted their wide use as a light source. Now, light emitting diodes are commonly applied in environmental lighting.

Commonly used outdoor illumination apparatus by LED for the road is an important application. Thus, a plurality of LEDs embedded into a road fence or barrier can increase the function of the fence or barrier. However, the heat dissipation and the waterproof aspect of the LED when used outdoors is a very significant issue.

Therefore, it is desirable to provide an LED illumination apparatus which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED illumination apparatus. Moreover, in the drawings, like reference numerals designate corresponding parts throughout the views.

DETAILED DESCRIPTION

An embodiment of an LED illumination apparatus as disclosed is described in detail here with reference to the drawings.

Figure 1:
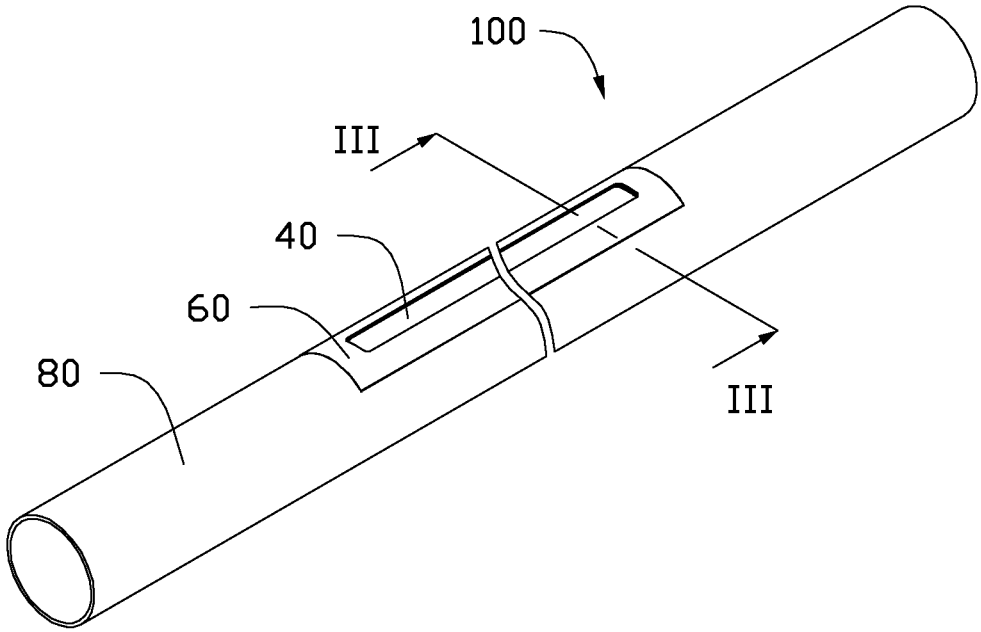
FIG. 1 is a schematic view of an LED illumination apparatus in accordance with a first embodiment.
Figure 2:
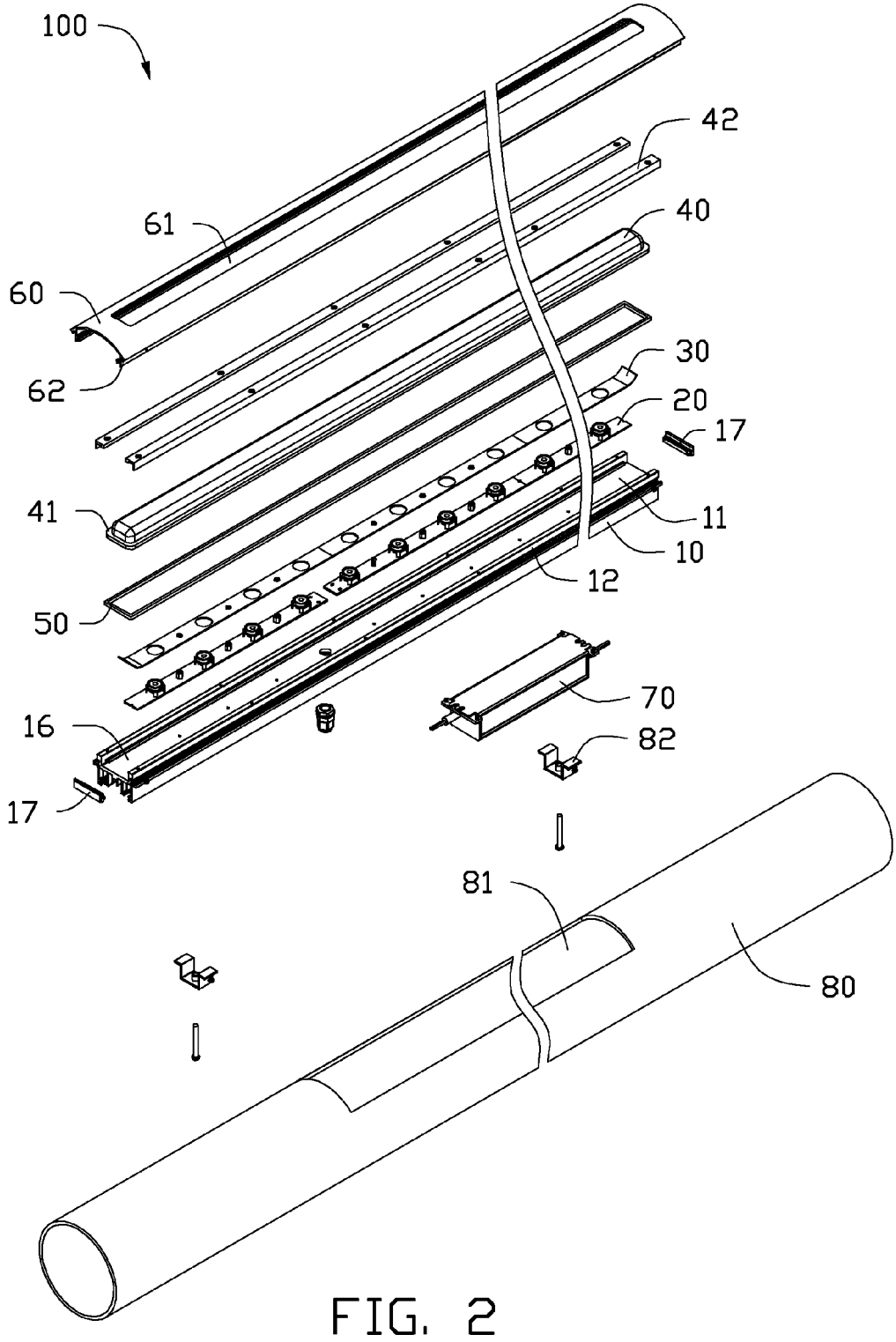
FIG. 2 is an exploded view of the apparatus of FIG. 1.
Figure 3:
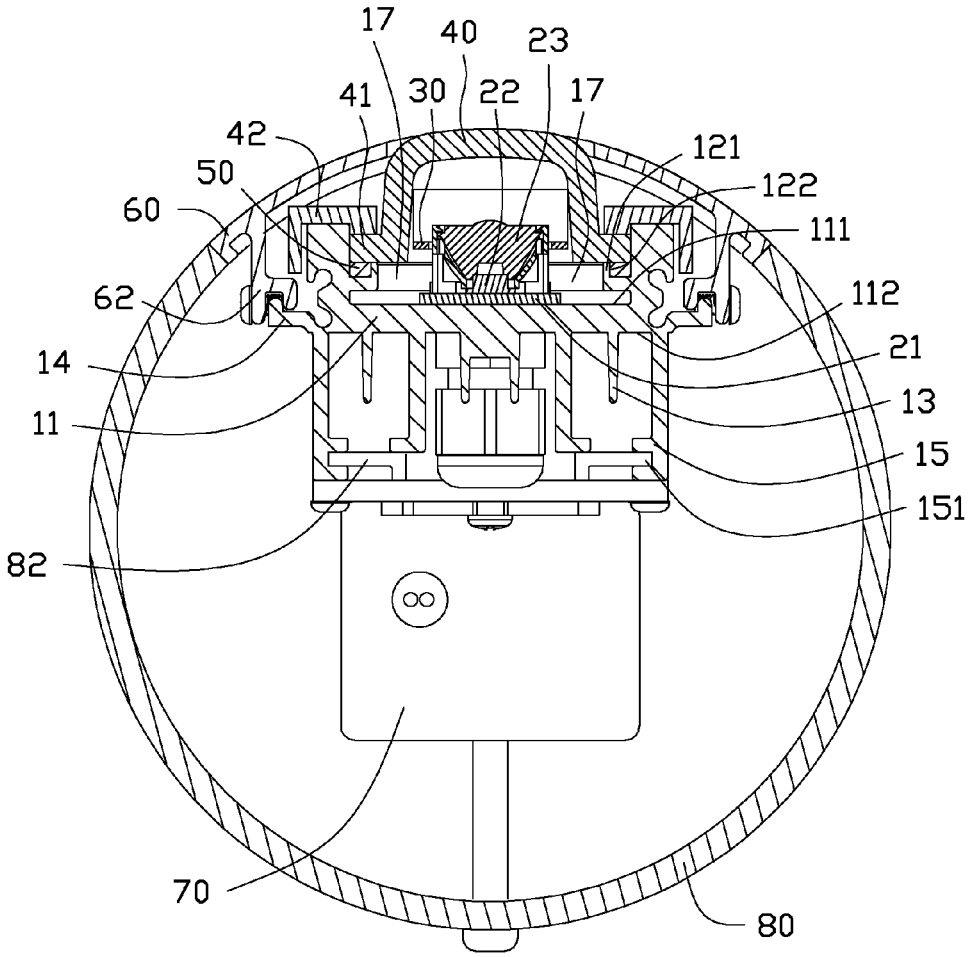
FIG. 3 is a cross section view of the apparatus of FIG. 1, taken along line III-III thereof.

Referring to FIGS. 1 to 3, an LED illumination apparatus 100 includes a body 10, a light source module 20, a reflection plate 30, a shell 40, a seal bar 50, a top cover 60, and a driver 70.

The body 10 includes a bottom plate 11, two side plates 12, a plurality of fins 13, a first fixing portion 14, and a second fixing portion 15. The body 10 is made of a metal with high heat conductivity and is integrally formed by extrusion or similar process. The body 10 is made of, for example, aluminum. The bottom plate 11 is a long strip which includes a first surface 111 and a second opposing surface 112. The two side plates 12 are formed on the first surface 111 of the bottom plate 11, and respectively extend along the two long sides of the first surface 111. The two side plates 12 are at right angles to the first surface 111. A support portion 121 extends inwards from the two opposing side plates 12. A cavity 122 with an opening farthest away from the bottom plate 11 is defined between the support portion 121 and the two side plates 12. A recess 16 is defined by the bottom plate 11 and the two side plates 12. Two seals or shutter 17 are arranged at the two longitudinal ends of the recess 16. The shutter 17 is fixed to the bottom plate 11 and the side plates 12 by welding or similar method. The fins 13 extend outwards from the second surface 112. The fins 13 are mutually parallel and at right angles to the second surface 112. The fins 13 increase the area for dissipation of heat. From the outside going in, the cross section of the first fixing portion 14 is in an "L" shape extending from and parallel to the bottom plate 11, and then bending down and merging into the bottom plate 11 on both lateral sides of the second surface 112. A cross section of the second fixing portion 15 shows an inverted "F" at the lowest point, extending vertically downwardly from the second surface 112. A fixture cavity 151 is defined by the two horizontal limbs of the inverted "F" shape at an inner side of each second fixing portion 15. The two fixture cavities 151 oppose each other.

The light source module 20 attached on the first surface 111 of the bottom plate 11 includes a substrate 21, a plurality of light emitting diode chips 22 on the surface of the substrate 21, and a plurality of lenses 23 respectively covering the light emitting diode chips 22. The light emitting angle of the lens 23 is 60°. The lenses 23 are located between the light emitting diode chips 22 and the shell 40.

A number of openings is defined in the reflection plate 30 attached on the substrate 21, each opening corresponding to the position of a light emitting diode chip 22. The reflection plate 30 reflects and redirects the light from the light emitting diode chip 22.

The shell 40 arranged on the body 10 covers the light source 20 and the reflection plate 30. The shell 40 includes a peripheral flange 41 and a central protrusion extending upwardly from the peripheral flange 41. The peripheral flange 41 sits flat on the support portion 121. The size of the shell 40 corresponds to that of the recess 16 and the shell 40 is arranged in the recess 16 so no gap exists between the shell 40 and the recess 16. A strip 42 has a screw fixing to the top of the side plate 12; the strip 42 bears down on the peripheral flange 41 to secure the shell 40 in the recess 16.

The seal bar 50 is arranged underneath the shell 40 to protect the light emitting diode chip 22 from water or vapor penetration.

The top cover 60 includes a central, substantially rectangular, orifice 61 for the emission of light, and a fixing element 62. The central protrusion of the shell 40 conformably fits into the orifice 61. The top cover 60 is itself shaped (approximately) as the ninety decree arc of a circle and is also made by extrusion or similar means. The shape of the central interior of the top cover 60 substantially matches that of the top surface of the shell 40. The fixing element 62 extends downwards to mate tightly with the first fixing portion 14 on the body 10.

The driver 70 is attached to the underside of the body 10 and electrically connects with the body 10 through a waterproof connector.

An opening 81 is defined in the steel (or other suitable material) tube 80 to accept the top cover 60 as a flush fit. The radius of curvature at the top of the steel tube 80 is the same as that of the top cover 60. The steel tube 80 connects securely to a bottom of the body 10 by means of a screw-fixed bracket 82. The bracket 82 is substantially U-shaped with two wings each fitted into a corresponding fixture cavity 151 of the body 10. A screw has a head abutting a bottom of the steel tube 80 and a shaft extending through the steel tube 80 to threadedly engage with the bracket 82.

While the disclosure has been described by way of example and in terms of one exemplary embodiment, it is to be understood that the disclosure is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED illumination apparatus, comprising:

a body;

a light source module arranged on the body including a substrate and at least one LED chip;

a shell made of transparent material covering the light source module;

a driver driving the light source module; and a steel tube having an opening, and the body connecting securely into the steel tube;

wherein a plurality of fins extends on a side of the body away from the light source module, and the body and the fins are integrally formed by extrusion.

2. The apparatus of claim 1, further comprising a reflection plate attached on the substrate, and an opening being defined on the reflection plate corresponding to the location of the at least one LED chip.

3. The apparatus of claim 1, further comprising a top cover having an orifice for the emission of light, wherein the top cover is fixed with the body by a fixing element, the shell having a central protrusion conformably fitting into the orifice.

4. The apparatus of claim 3, wherein the body further comprises a first fixing portion fixed with the fixing element.

5. The apparatus of claim 3, wherein the top cover is formed by metal extrusion.

6. The apparatus of claim 1, wherein the body comprises a bottom plate and two side plates oppositely arranged, and a recess is defined by the bottom plate and two side plates.

7. The apparatus of claim 6, wherein the body further comprises two shutters, and the shutters are arranged at two longitudinal ends of the recess.

8. The apparatus of claim 7, wherein each of the shutters is fixed on the bottom plate and the side plates by aluminum welding method.

9. The apparatus of claim 1, further comprising a screw-fixed bracket, and the steel tube being tightly connected to the body by the screw-fixed bracket.

10. The apparatus of claim 1, wherein a seal bar is arranged between the body and the shell.

11. The apparatus of claim 1, further comprising at least a lens located between the shell and the at least one LED chip and covering the at least one LED chip, the at least one lens having a light emitting angle of 60°.

* * * * *